US011643739B2

(12) United States Patent
Hashimoto et al.

(10) Patent No.: US 11,643,739 B2
(45) Date of Patent: May 9, 2023

(54) ANODE FOR ION EXCHANGE MEMBRANE ELECTROLYSIS VESSEL, AND ION EXCHANGE MEMBRANE ELECTROLYSIS VESSEL USING SAME

(71) Applicants: thyssenkrupp nucera Japan Ltd., Tokyo (JP); TOSOH CORPORATION, Shunan (JP)

(72) Inventors: Terumi Hashimoto, Tamano (JP); Koji Kawanishi, Tamano (JP); Fumio Sadahiro, Shunan (JP); Shota Shinohara, Shunan (JP); Sachio Kaneko, Shunan (JP)

(73) Assignees: TOSOH CORPORATION, Shunan (JP); THYSSENKRUPP NUCERA JAPAN LTD., Tokyo (JP)

( * ) Notice: Subject to any disclaimer, the term of this patent is extended or adjusted under 35 U.S.C. 154(b) by 864 days.

(21) Appl. No.: 15/110,358

(22) PCT Filed: Jan. 15, 2015

(86) PCT No.: PCT/JP2015/050964

§ 371 (c)(1),
(2) Date: Jul. 7, 2016

(87) PCT Pub. No.: WO2015/108115

PCT Pub. Date: Jul. 23, 2015

(65) Prior Publication Data

US 2016/0333488 A1 Nov. 17, 2016

(30) Foreign Application Priority Data

Jan. 15, 2014 (JP) ..... JP2014-005323

(51) Int. Cl.
*C25B 11/00* (2021.01)
*C25B 11/03* (2021.01)
(Continued)

(52) U.S. Cl.
CPC ..... *C25B 11/03* (2013.01); *C25B 1/46* (2013.01); *C25B 9/19* (2021.01)

(58) Field of Classification Search
CPC .... C25B 9/00; C25B 9/08; C25B 9/10; C25B 1/10
(Continued)

(56) References Cited

U.S. PATENT DOCUMENTS 4,605,482 A 8/1986 Shiragami et al.
4,839,013 A 6/1989 Lohrberg et al.
(Continued)

FOREIGN PATENT DOCUMENTS

CN 1054803 A 9/1991
CN 1275175 A 11/2000
(Continued)

OTHER PUBLICATIONS

Chinese Office Action and Search Report for Chinese Application No. 201580004868.1, dated Apr. 6, 2017.
(Continued)

*Primary Examiner* — Zulmariam Mendez
(74) *Attorney, Agent, or Firm* — Birch, Stewart, Kolasch & Birch, LLP

(57) ABSTRACT

Provided are an anode for an ion exchange membrane electrolyzer which enables an aqueous solution of an alkali metal chloride to be electrolyzed at a lower voltage than a conventional anode and allows the concentration of an impurity gas included in an anode gas to be reduced and an ion exchange membrane electrolyzer using the same. The anode is an anode for an ion exchange membrane electrolyzer to be used in an ion exchange membrane electrolyzer that is separated by an ion exchange membrane into an anode chamber and a cathode chamber. The anode for an ion exchange membrane electrolyzer comprises at least one
(Continued)

perforated flat metal plate 1 (expanded metal 1) and the thickness of the perforated flat metal plate 1 (expanded metal 1) ranges from 0.1 to 0.5 mm and the ratio of the short way SW to the long way LW (SW/LW) ranges from 0.45 to 0.55. The short way SW is preferably not more than 3.0 mm.

1 Claim, 2 Drawing Sheets

(51) Int. Cl.
*C25B 1/46* (2006.01)
*C25B 9/19* (2021.01)

(58) Field of Classification Search
USPC ..... 204/252
See application file for complete search history.

(56) References Cited

U.S. PATENT DOCUMENTS

| | | | |
|---|---|---|---|
| 5,221,452 | A | 6/1993 | Nakao et al. |
| 5,776,328 | A | 7/1998 | Traini et al. |
| 6,368,473 | B1 | 4/2002 | Furuya et al. |
| 6,395,153 | B1 | 5/2002 | Matousek et al. |
| 2006/0042935 | A1 | 3/2006 | Houda |
| 2013/0240371 | A1 | 9/2013 | Bulan et al. |
| 2013/0299342 | A1 | 11/2013 | Suemoto |
| 2015/0299876 | A1* | 10/2015 | Hara ..... C25B 11/03 205/455 |

FOREIGN PATENT DOCUMENTS

| | | | |
|---|---|---|---|
| EP | 2639338 | A2 | 9/2013 |
| JP | 58-42778 | A | 3/1983 |
| JP | 58-130286 | A | 8/1983 |
| JP | 62-502820 | A | 11/1987 |
| JP | 4453973 | B2 | 4/2010 |
| JP | 2012-140654 | A | 7/2012 |
| WO | WO 86/06758 | A1 | 11/1986 |

OTHER PUBLICATIONS

Japanese Office Action for Japanese Application No. 2015-557873, dated Apr. 18, 2017.
Extended European Search Report, dated Jul. 28, 2017, for European Application No. 15737891.0.
International Search Report (PCT/ISA/210) issued in PCT/JP2015/050964, dated Apr. 15, 2015.
Written Opinion (PCT/ISA/237) issued in PCT/JP2015/050964, dated Apr. 15, 2015.
Indian Office Action, dated Aug. 1, 2018, for Indian Application No. 201627027312, along with an English translation.

* cited by examiner

ANODE FOR ION EXCHANGE MEMBRANE ELECTROLYSIS VESSEL, AND ION EXCHANGE MEMBRANE ELECTROLYSIS VESSEL USING SAME

TECHNICAL FIELD

The present invention relates to an anode for an ion exchange membrane electrolyzer (electrolysis vessel) and an ion exchange membrane electrolyzer using the same (hereinafter also referred to simply as "anode" and "electrolyzer") and particularly relates to an anode for an ion exchange membrane electrolyzer which enables an aqueous solution of an alkali metal chloride to be electrolyzed at a lower voltage than a conventional anode and allows the concentration of an impurity gas included in an anode gas to be reduced and to an ion exchange membrane electrolyzer using the same.

BACKGROUND ART

In the electrolysis of an aqueous solution of an alkali metal chloride by an ion exchange membrane-mediated method, such as brine electrolysis, the electric power consumption rate is reflected in the cost of producing products such as caustic soda (NaOH) and chlorine gas ($Cl_2$). Moreover, since electricity is used in electrolysis, it releases carbon dioxide ($CO_2$) gas during the generation of electricity and thus has a negative impact on global warming. In such social settings, there currently is a need for an ion exchange membrane electrolyzer that can reduce the electrolysis voltage even further during the operation of the electrolyzer.

To address such a problem, various items such as the configuration of a cathode, the coating and the power feeding method for an ion exchange membrane electrolyzer have been studied so far. For example, Patent Document 1 has proposed a technology to reduce electrolysis voltage by decreasing the size of an expanded metal mesh used as a cathode. On the other hand, as for an anode, Patent Document 2 has proposed a technology to improve the electrolysis performance by keeping the opening ratio of an expanded metal mesh within a predetermined range. Moreover, in addition, a technique to reduce electrolysis voltage by applying a coating on an anode has been known. Patent Document 3 has proposed an anode composed of a metal mesh with substantially diamond-shaped perforations, in which the ratio of strand and perforation, and the long way distance LWD and the short way distance SWD of the perforations have been set to predetermined values. This Patent Document 3 has disclosed that a platinum group metal oxide, magnetite, ferrite, cobalt spinel, or a mixed metal oxide can be used as a coating.

RELATED ART DOCUMENTS

Patent Documents

Patent Document 1: Japanese Unexamined Patent Application Publication No. 2012-140654
Patent Document 2: Japanese Patent No. 4453973
Patent Document 3: Japanese Unexamined Patent Application Publication (Translation of PCT Application) No. Sho 62-502820

SUMMARY OF THE INVENTION

Problems to be Solved by the Invention

In recent years, further lowering of electrolysis voltage is requested in terms of environmental impacts, production costs and the like. In such a situation, as for an anode, the opening ratio for an expanded metal mesh was studied but the relationship between the configuration of an anode and the electrolysis voltage was not sufficiently studied in Patent Documents 2 and 3. As just described, it is difficult to study the configuration of an anode for an ion exchange membrane electrolyzer at the industrial level and, therefore, the configuration of an anode has not been changed at all since over 10 years ago. Moreover, even if lowering of electrolysis voltage is attempted by applying a predetermined coating on an electrolysis anode, the attempt has a problem with an increased concentration of an impurity gas in an anode gas.

Then, an object of the present invention is to provide an anode for an ion exchange membrane electrolyzer which enables an aqueous solution of an alkali metal chloride to be electrolyzed at a lower voltage than a conventional anode and allows the concentration of an impurity gas included in an anode gas to be reduced and an ion exchange membrane electrolyzer using the same.

Means for Solving the Problems

The inventors had intensively studied to solve the above-described problems and consequently obtained the following finding. That is, by reducing the thickness of an anode to not more than about a half of that of a conventional anode and adjusting the ratio of perforation dimensions in the longitudinal and transverse directions, (1) the cell voltage during electrolysis and also (2) the retention time of hydroxide ions ($OH^-$) on the surface of an anode, which ions have diffused from a cathode chamber through an ion exchange membrane, can be reduced and consequently the volume of an impurity gas produced in the reaction of the hydroxide ions, that is, oxygen ($O_2$) gas can be decreased.

Based on the finding, the inventors have intensively studied further and consequently found that the above-described problems can be solved by forming an anode in a configuration as described below, and thereby completed the present invention.

That is, an anode for an ion exchange membrane electrolyzer of the present invention is an anode for an ion exchange membrane electrolyzer to be used in an ion exchange membrane electrolyzer that is separated by an ion exchange membrane into an anode chamber and a cathode chamber, characterized in that the anode for the ion exchange membrane electrolyzer comprises at least one perforated flat metal plate, and that the thickness of the perforated flat metal plate ranges from 0.1 to 0.5 mm and the ratio of the short way SW to the long way LW (SW/LW) ranges from 0.45 to 0.55.

In the anode for an ion exchange membrane electrolyzer of the present invention, the short way SW is preferably not more than 3.0 mm.

Moreover, another anode for an ion exchange membrane electrolyzer of the present invention is an anode for an ion exchange membrane electrolyzer to be used in an ion exchange membrane electrolyzer that is separated by an ion exchange membrane into an anode chamber and a cathode chamber, characterized in that the anode for the ion exchange membrane electrolyzer comprises a woven mesh made of a metal wire, and that the wire diameter d of the metal wire is not more than 0.20 mm and the ratio of the wire diameter d of the metal wire to the distance D between the adjacent metal wires in a generally parallel arrangement (d/D) ranges from 0.40 to 0.55.

Furthermore, an ion exchange membrane electrolyzer of the present invention is an ion exchange membrane electrolyzer comprising an anode chamber and a cathode chamber separated by an ion exchange membrane, wherein the anode chamber contains an anode and the cathode chamber contains a cathode, characterized in that the anode is either of the above-described anodes for an ion exchange membrane electrolyzer of the present invention.

Effects of the Invention

The present invention can provide an anode for an ion exchange membrane electrolyzer which enables an aqueous solution of an alkali metal chloride to be electrolyzed at a lower voltage than a conventional anode and allows the concentration of an impurity gas included in an anode gas to be reduced and an ion exchange membrane electrolyzer using the same.

MODE FOR CARRYING OUT THE INVENTION

Now, embodiments of the present invention will be described in detail with reference to drawings.

Figure 1:
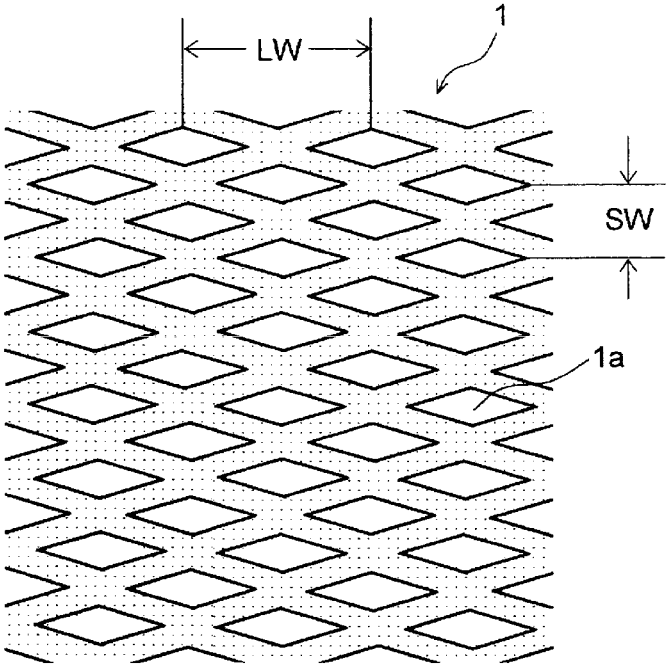
FIG. 1 shows an enlarged view of a general part of an anode for an ion exchange membrane electrolyzer according to one preferable embodiment of the present invention.

An anode for an ion exchange membrane electrolyzer of the present invention is an anode used for an ion exchange membrane electrolyzer comprising an anode chamber and a cathode chamber separated by an ion exchange membrane, wherein the anode chamber contains an anode and the cathode chamber contains a cathode. FIG. 1 shows an enlarged view of a general part of the anode for an ion exchange membrane electrolyzer according to one preferable embodiment of the present invention. In one preferable embodiment of the present invention, the anode comprises at least one perforated flat metal plate. In FIG. 1, the perforated flat metal plate 1 is exemplified by the expanded metal 1. However, the perforated flat metal plate is not particularly limited as long as it is a metal plate with perforations. For example, in addition to expanded metal products, punching metal products with punched holes in the shape of a circle, square or the like may be used. Moreover, the perforated flat metal plate may be a product comprising multiple layers of these metal products.

In one preferable embodiment of the present invention, the thickness of the perforated flat metal plate 1 (the expanded metal 1 in the illustrated example) ranges from 0.1 to 0.5 mm. The anode of the present invention is required to have a thickness equal to or less than a half of that of a conventional anode, that is, not more than 0.5 mm. However, when an aqueous solution of an alkali metal chloride is electrolyzed, the pressure to be applied in a cathode chamber is normally higher than that in an anode chamber. Thus, the anode is required to have the strength to resist the pressure from the cathode chamber. Then, in the anode according to one preferable embodiment of the present invention, the thickness of the perforated flat metal plate 1 is required to be not less than 0.1 mm. It is preferably from 0.2 to 0.5 mm.

Moreover, in one preferable embodiment of the present invention, the ratio of the short way SW to the long way LW (SW/LW) in the perforated flat metal plate 1 (the expanded metal 1 in the illustrated example) ranges from 0.45 to 0.55, in which the short way SW refers to the short way distance between the center of the joint to the center of the joint of the perforation 1*a* and the long way LW refers to the long way distance between the center of the joint to the center of the joint of the perforation 1*a*. By keeping the thickness of the perforated flat metal plate 1 within the range from 0.1 to 0.5 mm as well as keeping the ratio of the short way SW to the long way LW within the above-described range, the above-mentioned retention time of $OH^-$ ions on the surface of the perforated flat metal plate 1 can be most shortened and consequently the volume of an impurity gas ($O_2$) produced on the anode can be reduced. Preferably, the ratio SW/LW ranges from 0.48 to 0.50.

In one preferable embodiment of the present invention, the short way SW of the perforated flat metal plate 1 (the expanded metal 1 in the illustrated example) is preferably not more than 3.0 mm. Setting the short way SW to not more than 3.0 mm can provide more uniform current distribution during electrolysis. Incidentally, the lower limit of the short way SW is not particularly limited but it is preferably not less than 0.5 mm in order to ensure the strength of the anode.

In the anode for an ion exchange membrane electrolyzer according to one preferable embodiment of the present invention, it is important for the anode only to comprise at least one perforated flat metal plate 1 having a thickness ranging from 0.1 to 0.5 mm and a ratio of the short way SW to the long way LW (SW/LW) ranging from 0.45 to 0.55, and known configurations can be adopted for other elements. For example, in cases where an expanded metal 1 is used as the perforated flat metal plate 1, a titanium expanded metal produced by shearing and then expanding a plate material and subsequently flattened by rolling and the like can be preferably used. Additionally, a coating of an electrode catalyst material, such as a platinum group metal oxide, magnetite, ferrite, cobalt spinel, or a mixed metal oxide, may be formed on the surface of the anode to reduce the electrolysis voltage.

Moreover, as mentioned above, in the anode for an ion exchange membrane electrolyzer according to one preferable embodiment of the present invention, multiple layers of perforated flat metal plates may also be used to further ensure the strength of the anode. However, in this case, the thickness of a perforated flat metal plate on the side adjacent to an ion exchange membrane should be within the range from 0.1 to 0.5 mm, while the ratio of the short way SW to the long way LW (SW/LW) should be within the range from 0.45 to 0.55. Additionally, in the present invention, a conventionally used perforated flat metal plate may also be layered over the back of the perforated flat metal plate to further ensure the strength of the anode.

Figure 2:
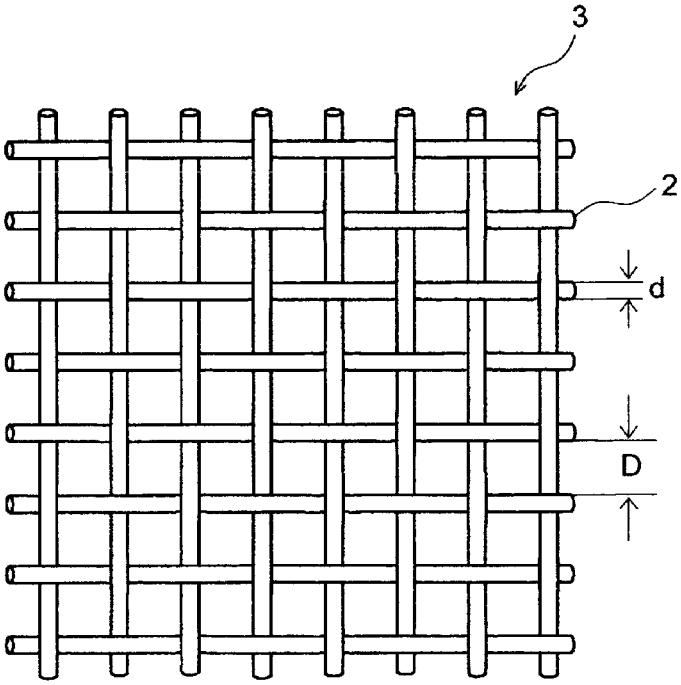
FIG. 2 shows an enlarged view of a general part of an anode for an ion exchange membrane electrolyzer according to another preferable embodiment of the present invention.

Next, an anode for an ion exchange membrane electrolyzer according to another preferable embodiment of the present invention will be described. FIG. 2 shows an enlarged view of a general part of the anode for an ion exchange membrane electrolyzer according to another preferable embodiment of the present invention. In another preferable embodiment of the present invention, the anode is a woven mesh 3 made of a metal wire 2.

In another preferable embodiment of the present invention, the wire diameter d of the metal wire 2 used for the anode is not more than 0.20 mm. As mentioned above, the thickness of the anode is required to be not more than a half of that of an expanded metal conventionally used widely as an anode. Then, in another preferable embodiment of the present invention, the wire diameter d of the metal wire 2 to compose an anode should be not more than 0.20 mm, such that the thickness of the anode is not more than 0.5 mm even if the anode is a mesh woven from the wire. However, as mentioned above, because the pressure to be applied in a cathode chamber is normally higher than that in an anode chamber, an anode is required to have the strength to resist the pressure from the cathode chamber. Thus, the wire diameter d of the metal wire 2 preferably ranges from 0.10 to 0.20 mm.

Moreover, in another preferable embodiment of the present invention, the ratio of the wire diameter d of the metal wire 2 to the distance D between the adjacent metal wires 2 in a generally parallel arrangement (d/D) ranges from 0.40 to 0.55. By keeping the wire diameter d of the metal wire 2 within the above-described range as well as keeping d/D within the above-described range, the above-mentioned retention time of $OH^-$ ions on the surface of the woven mesh 3 made of the metal wire 2 can be most shortened and consequently the volume of an impurity gas ($O_2$) can be reduced.

In the anode for an ion exchange membrane electrolyzer of another preferable embodiment of the present invention, it is important for the anode only to be a woven mesh 3 made of a metal wire 2 having a wire diameter equal to or less than 0.20 mm, which is the wire diameter d of the metal wire 2, and to have a ratio of d/D within the range from 0.40 to 0.55, which is the ratio of the wire diameter d of the metal wire 2 to the distance D between the adjacent metal wires 2 in a generally parallel arrangement, and known configurations for the anode can be adopted for other elements. For example, a titanium metal wire can be used as the metal wire 2 and a woven mesh made of the titanium metal wire can be preferably used as an anode. Additionally, a coating of an electrode catalyst material, such as a platinum group metal oxide, magnetite, ferrite, cobalt spinel, or a mixed metal oxide, may be formed on the surface of this metal wire 2 to reduce the electrolysis voltage.

Next, an ion exchange membrane electrolyzer of the present invention will be described.

Figure 3:
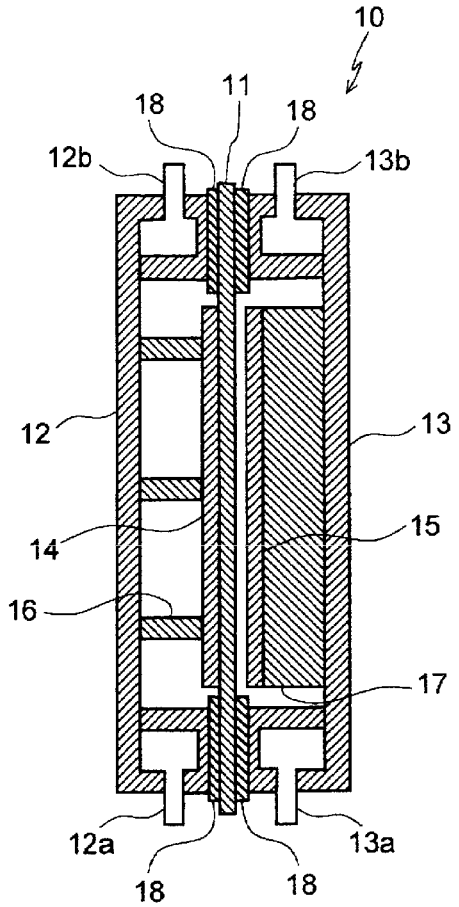
FIG. 3 shows a schematic cross-sectional view of an ion exchange membrane electrolyzer according to one preferable embodiment of the present invention.

FIG. 3 shows a cross-sectional view of the ion exchange membrane electrolyzer according to one preferable embodiment of the present invention. As shown in the figure, the ion exchange membrane electrolyzer of the present invention 10 is separated into an anode chamber 12 and a cathode chamber 13 by an ion exchange membrane 11 and an anode 14 and a cathode 15 are contained in the anode chamber 12 and the cathode chamber 13, respectively. In the illustrated example, the anode 14 is anchored to an anode-supporting body 16 such as an anode rib in the anode chamber 12, while the cathode 15 is anchored to the cathode chamber 13 through a cathode current collector 17 in the cathode chamber 13.

In the electrolyzer of the present invention 10, either of the above-described anodes for an ion exchange membrane electrolyzer of the present invention is used as the anode 14. As mentioned above, by applying the anode for an ion exchange membrane electrolyzer of the present invention to the ion exchange membrane electrolyzer 10, an aqueous solution of an alkali metal chloride can be electrolyzed at a lower voltage than by applying a conventional anode and the concentration of an impurity gas ($O_2$) included in an anode gas ($Cl_2$), which impurity gas is originated from hydroxide ions ($OH^-$) diffused from the cathode chamber through the ion exchange membrane, can be reduced.

The electrolyzer of the present invention 10 is an electrolyzer comprising the anode chamber 12 and the cathode chamber 13 separated by the ion exchange membrane 11, in which the anode chamber contains the anode 14 and the cathode chamber contains the cathode 15. It is important for the electrolyzer only to use either of the above-described anodes for an ion exchange membrane electrolyzer of the present invention as the anode 14, and known configurations for the ion exchange membrane electrolyzer can be adopted for other elements.

For example, as for the cathode 15, the cathode is not particularly limited as long as it is a cathode typically used for electrolysis, and a known cathode, for example, an expanded metal made of such a corrosion-resistant metal as nickel can be used. Additionally, a coating of an electrode catalyst material including a platinum group metal oxide may be formed on the surface of the cathode 15.

Moreover, in the illustrated example, the anode chamber 12 and the cathode chamber 13 are assembled together and tightly sealed with a gasket 18 and the distance between the anode 14 and the cathode 15 is adjusted by the thickness of the gasket 18 and the lengths of the anode-supporting body 16 and the cathode current collector 17. The electrolyzer may be operated with the cathode 15 and the ion exchange membrane 11 spaced around 1 to 2 mm apart as shown in the figure, but the electrolyzer may be operated with the ion exchange membrane 11 and the cathode 15 adhered together in a substantial manner.

Incidentally, the illustrated example shows a unit electrolyzer composed of a pair of the anode chamber 12 and the cathode chamber 13 assembled together but the ion exchange membrane electrolyzer of the present invention may be a system in which a multiple number of such unit electrolyzers are assembled together. Moreover, in the electrolyzer of the present invention, bipolar units, each comprising an anode chamber and a cathode chamber connected to each other by sharing an outer surface to provide an anode and a cathode on the opposing surfaces of the unit, may be assembled with an ion exchange membrane in between and assembled further with an anode unit and a cathode unit at the opposite ends of the assembly through an ion exchange membrane, one of which units comprises only one of either an anode chamber or a cathode chamber and the other unit comprises the other chamber.

Brine electrolysis using the ion exchange membrane electrolyzer of the present invention 10 is carried out by allowing an electric current to flow between both electrodes while feeding a brine solution from an anode chamber inlet 12*a* provided in the anode chamber 12 and a diluted aqueous solution of sodium hydroxide from a cathode chamber inlet 13*a* provided in the cathode chamber 13. At that time, a higher pressure is applied to the cathode chamber 13 than to the anode chamber 12 to adhere the ion exchange membrane 11 to the anode 14, so that the electrolyzer can be operated efficiently. Additionally, the anode solution is discharged along with a product of the electrolysis from an anode chamber outlet 12*b* in the anode chamber 12 and the cathode solution containing another product of the electrolysis is also discharged from a cathode chamber outlet 13*b* in the cathode chamber 13.

EXAMPLES

Now, the present invention will be described in more detail by way of Examples.

Examples 1 to 7, Comparative Examples 1 to 8 and Conventional Example

Anode electrodes formed from titanium expanded metals were produced according to the conditions indicated in Table 1 below and each of them was installed into an ion exchange membrane electrolyzer of a type as shown in FIG. 3. Then, brine electrolysis was performed according to the electrolysis conditions as described below. Additionally, the electrolysis area of the ion exchange membrane electrolyzer was 1 $dm^2$, and a zero-gap type active cathode was used as an electrolysis cathode, and a cation exchange membrane for brine electrolysis was used as a barrier membrane. Moreover, the same coating material was used for all the electrolysis anodes.

Examples 8 and 9 and Comparative Examples 9 and 10

Anode electrodes formed from woven metal meshes, which had been produced by weaving metal wires, were produced according to the conditions indicated in Table 2 below and each of them was installed into an ion exchange membrane electrolyzer of a type as shown in FIG. 3. Then, brine electrolysis was performed according to the electrolysis conditions as described below. Additionally, the electrolysis area of the ion exchange membrane electrolyzer was 1 $dm^2$, and a zero-gap type active cathode was used as an electrolysis cathode, and a cation exchange membrane for brine electrolysis was used as a barrier membrane. Moreover, the same coating material was used for all the electrolysis anodes.

<Electrolysis Conditions>

A solution of 200±10 g/L NaCl was used as an anode solution, while an aqueous solution of 32±0.5% by mass of NaOH was used as a cathode solution. The electrolysis temperature was within the range from 86 to 88° C., and the current density was 6 $kA/m^2$.

<Evaluation>

Cell voltage, current efficiency, and oxygen concentration ($O_2$ concentration) in chlorine ($Cl_2$) gas during the brine electrolysis using each electrolyzer were measured and the values from each of Examples and Comparative Examples were subtracted by the values from Conventional Example and then the obtained values were used for the evaluation. When the voltage difference (V) and $O_2$ concentration in an anode had negative values, the anode received a "Pass" designation. Incidentally, considering errors generated during the operation of an electrolyzer, in cases where the current efficiency of an anode is not less than −0.3%, the current efficiency of the anode is considered to be at a similar level to that of a conventional anode. The obtained results are collectively shown in Tables 1 and 2.

TABLE 1

| | Thickness (mm) | SW (mm) | SW/LW | Voltage difference (V) | Difference of current efficiency (%) | Difference of $O_2$ concentration (vol. %) |
|---|---|---|---|---|---|---|
| Conventional Example | 1.00 | more than 3.0 | 0.58 | 0.00 | 0.0 | 0.00 |
| Comparative Example 1 | 0.50 | not more than 3.0 | 0.60 | 0.01 | −0.4 | −0.38 |
| Comparative Example 2 | 0.29 | not more than 3.0 | 0.67 | 0.05 | −0.2 | 0.06 |
| Comparative Example 3 | 0.25 | not more than 3.0 | 0.67 | 0.01 | −2.6 | 0.22 |
| Comparative Example 4 | 0.27 | not more than 3.0 | 0.43 | 0.01 | 0.2 | 0.06 |
| Example 1 | 0.43 | not more than 3.0 | 0.50 | −0.03 | 0.0 | −0.18 |
| Example 2 | 0.50 | not more than 3.0 | 0.50 | −0.02 | −0.1 | −0.18 |
| Example 3 | 0.50 | not more than 3.0 | 0.50 | −0.01 | −0.1 | −0.19 |
| Comparative Example 5 | 0.75 | not more than 3.0 | 0.50 | −0.02 | −0.1 | 0.23 |
| Comparative Example 6 | 0.45 | not more than 3.0 | 0.67 | −0.02 | −0.1 | 0.19 |
| Comparative Example 7 | 0.71 | not more than 3.0 | 0.50 | 0.01 | −0.7 | 0.06 |
| Comparative Example 8 | 0.71 | not more than 3.0 | 0.50 | 0.00 | −3.7 | 0.22 |
| Example 4 | 0.15 | more than 3.0 | 0.50 | −0.06 | 0.6 | −0.50 |
| Example 5 | 0.20 | not more than 3.0 | 0.50 | −0.06 | 0.4 | −0.60 |
| Example 6* | 0.15<br>1.00 | not more than 3.0<br>more than 3.0 | 0.50<br>— | −0.02 | −0.3 | −0.35 |

TABLE 1-continued

| | Thickness (mm) | SW (mm) | SW/LW | Voltage difference (V) | Difference of current efficiency (%) | Difference of $O_2$ concentration (vol. %) |
|---|---|---|---|---|---|---|
| Example 7* | 0.15<br>1.50 | not more than 3.0<br>more than 3.0 | 0.50<br>— | −0.03 | −0.1 | −0.30 |

*Conditions for two layers of expanded mesh products were indicated: upper line, the conditions for an expanded mesh product on the side adjacent to an ion exchange membrane; lower line, the conditions for an expanded mesh product on the opposite side.

TABLE 2

| | d (mm) | d/D | Voltage difference (V) | Difference of current efficiency (%) | $O_2$ concentration (vol. %) |
|---|---|---|---|---|---|
| Example 8 | 0.15 | 0.46 | −0.08 | 0.5 | −0.01 |
| Example 9 | 0.20 | 0.55 | −0.02 | −0.3 | −0.03 |
| Comparative Example 9 | 0.15 | 0.31 | −0.02 | −0.2 | 0.10 |
| Comparative Example 10 | 0.20 | 0.65 | −0.01 | −0.5 | 0.03 |

Table 1 indicates that an anode thickness equal to or less than 0.50 mm and a ratio of SW/LW around 0.50, which represents the configuration of a mesh, cause the solution feeding to the electrolysis surface and the voltage to be significantly changed, the latter of which is mediated by outgassing and the like, and consequently achieve the reduction in electrolysis voltage and $O_2$ gas production.

Figure 4:
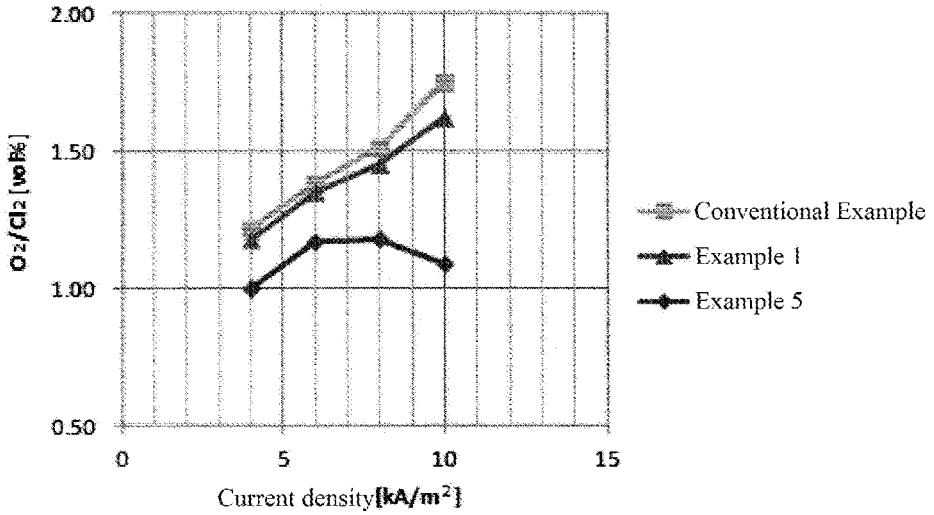
FIG. 4 shows a graph indicating the relationship between the current density and the concentration of $O_2$ gas in the brine electrolysis using the anode in Conventional Example, Examples 1 and 5.

Moreover, as shown in Conventional Example and Examples 1 and 5, a smaller thickness enables the concentration of oxygen gas, which is an impurity ingredient in the chlorine gas, to be reduced. FIG. 4 shows a graph indicating the relationship between the current density and the concentration of $O_2$ gas in the brine electrolysis using the anodes of Conventional Example, Examples 1 and 5. FIG. 4 indicated that changing the current density to 4, 6, 8, 10 ($kA/m^2$) led to a more significant difference in $O_2$ gas production in accordance with the increment of current density when brine electrolysis was performed using anodes of Conventional Example and Examples 1 and 5.

On the other hand, since an ion exchange membrane electrolyzer for electrolyzing at the industrial level an aqueous solution of an alkali metal chloride by an ion exchange membrane-mediated method is operated while a pressure is applied on a cathode, an anode mesh with an extremely thin thickness cannot maintain the strength. Then, two layers of the expanded metal products were used in Examples 6 and 7 and the reduction in voltage and the effect of reducing $O_2$ gas production were confirmed in either of the cases.

The description, the claims, the drawings and the abstract of Japanese Patent Application No. 2014-005323 filed Jan. 15, 2014 cited hereby are incorporated by reference in their entirety in the disclosure of the description of the invention.

DESCRIPTION OF SYMBOLS

1. Perforated flat metal plate (Expanded metal)
1*a*. Perforation
2. Metal wire
3. Woven mesh made of a metal wire
10. Ion exchange membrane electrolyzer
11. Ion exchange membrane
12. Anode chamber
12*a*. Anode chamber inlet
12*b*. Anode chamber outlet
13. Cathode chamber
13*a*. Cathode chamber inlet
13*b*. Cathode chamber outlet
14. Anode
15. Cathode
16. Anode-supporting body
17. Cathode current collector
18. Gasket

The invention claimed is:

1. An ion exchange membrane electrolyzer comprising an anode chamber and a cathode chamber separated by an ion exchange membrane, wherein the anode for the ion exchange membrane electrolyzer comprises a woven mesh made of a metal wire, and that the wire diameter d of the metal wire is from 0.10 mm to less than 0.15 mm and the ratio of the wire diameter d of the metal wire to the distance D between the adjacent metal wires in a generally parallel arrangement (d/D) ranges from 0.46 to 0.55, and wherein the ion exchange membrane and the cathode are adhered together in a manner.

* * * * *